US007241064B2

(12) United States Patent
Yanagisako

(10) Patent No.: US 7,241,064 B2
(45) Date of Patent: Jul. 10, 2007

(54) GRIP OF WRITING MATERIAL

(75) Inventor: Takashi Yanagisako, Iruma (JP)

(73) Assignee: Platinum Pen Co., Ltd., Tokyo (JP)

( * ) Notice: Subject to any disclaimer, the term of this patent is extended or adjusted under 35 U.S.C. 154(b) by 0 days.

(21) Appl. No.: 11/273,016

(22) Filed: Nov. 15, 2005

(65) Prior Publication Data

US 2006/0120793 A1 Jun. 8, 2006

(51) Int. Cl.
*A46B 5/02* (2006.01)

(52) U.S. Cl. ..... 401/6

(58) Field of Classification Search ..... 401/6, 401/48; 16/430
See application file for complete search history.

(56) References Cited

U.S. PATENT DOCUMENTS

| | | | | |
|---|---|---|---|---|
| 782,388 | A * | 2/1905 | Goldsmith et al. | 15/443 |
| 811,390 | A * | 1/1906 | Foreman | 81/489 |
| 1,868,441 | A * | 7/1932 | Colfelt | 15/443 |
| 2,173,451 | A * | 9/1939 | Lorber | 401/6 |
| 6,390,704 | B1 * | 5/2002 | Baudino et al. | 401/6 |

FOREIGN PATENT DOCUMENTS

| | | |
|---|---|---|
| JP | 63-60375 | 4/1988 |
| JP | 11314485 | 11/1999 |
| JP | 200289378 | 10/2000 |
| JP | 2002 347382 | 4/2002 |

* cited by examiner

*Primary Examiner*—David J. Walczak
(74) *Attorney, Agent, or Firm*—Browdy and Neimark PLLC

(57) ABSTRACT

A grip of a writing material is formed by providing a plurality of flange-like on a surface of a middle shaft portion of a shaft cylinder and in parallel across an axis of the shaft cylinder, the plurality of flange-like projections projecting in a radial direction of the shaft cylinder, and integrally covering the flange-like projections with a cylindrical cover in a closable manner so that spaces are formed inside the cover. When a user grips the grip of the writing material with his or her fingers, the pressure allows the cover to be borne by the adjacent flange-like projections, while moving air inside the spaces to deform the cover. The deformation absorbs the pressure from the fingers. Further, the adjacent flange-like projections limits the deformation of the cover, thus enabling the initial positional relationship of the fingers to be maintained. The user can thus use the writing material for a long time.

8 Claims, 6 Drawing Sheets

GRIP OF WRITING MATERIAL

BACKGROUND OF THE INVENTION

The present invention relates to a grip of a writing material which is installed near the tip of a shaft cylinder of the writing material and which can reduce the burden on user's fingers for a prolonged use of the writing material.

Some conventional writing materials include a cylindrical grip installed near the tip of shaft cylinder of the writing material which cylindrical grip consisting of an elastic material having concaves and convexes formed on its surface. The purpose of using the cylindrical grip is to reduce burdens on a user's fingers and to prevent the fingers from slipping readily on the shaft cylinder owing to moisture such as sweat, when the writing material is used for a long hours.

With the cylindrical grip consisting of the elastic material such as rubber and simply having concaves and convexes formed on its surface, even if the moisture of sweat on the fingers resulting from the long use of the writing material adheres to a surface of the grip, the user's fingers are locked on the concaves and convexes on the surface. Consequently, the writing material can be reliably gripped. However, if the cylindrical grip consisting of the elastic material such as rubber is thin, it is not readily deformed. When such writing material is used for a long time, pressure from the fingers is unlikely to be absorbed. Consequently, the long use of the writing material imposes burdens on the fingers, for example, makes the fingers numb, just as in the case of the direct gripping of the shaft cylinder of the writing material. In contrast, a thicker grip exerts a stronger force of restitution in response to the pressure from the fingers when the writing material is gripped. When the writing material is kept gripped for a long time against the force of restitution of the grip, the fingers must exert a stronger force than they otherwise need to do. This fatigues the user and thus imposes excessive burdens on the user.

Thus, the grips of writing materials just described below have been proposed which are elastic and which absorb the pressure from the fingers while being readily deformed during writing, thus avoiding imposing excessive burdens on the user.

For example, the grip installed near the tip of shaft cylinder of the writing material comprising a soft elastic member such as soft rubber or thermoplastic elastomer has been proposed. In this case, the pressure from the user's fingers during writing or the like is easily absorbed by deformation of the grip. However, since the soft elastic member such as soft rubber or thermoplastic elastomer is likely to be deformed, if it is installed in the shaft cylinder of the writing material, the pressure from the user's fingers during writing significantly deforms the writing material in the axial direction of the shaft cylinder. This readily shifts the positions of the fingers optimum for gripping the writing material. The user must thus frequently re-grip the writing material.

The grip of the writing material comprising a cylindrical shape memory resin in which silicone oil or other gel substance is sealed has been proposed. In this case, the pressure exerted during writing markedly deforms the grip in the axial direction of the shaft cylinder, thus readily shifting the original positions of the fingers optimum for the user, as in the case in which the grip is composed of the soft elastic member such as soft rubber or thermoplastic elastomer. Consequently, the user cannot reliably grip the writing material and must re-grip the wiring material many times during long writing. Furthermore, the grip requires a firm sealing structure that prevents the leakage of silicone oil or other gel material sealed in the grip. This makes the structure of the grip complicated and requires much attention to be paid to the material of the grip. As a result, manufacturing costs increase sharply.

Moreover, the grip of the writing material having a rib formed on an inner wall surface of a cylinder of a soft material and extending in the axial direction of the shaft cylinder, to create cavities inside areas against which the thumb, the index finger, and the middle finger abut has been proposed. In this case, deformation of the cavities absorbs the pressure from the fingers acting in the radial direction of the shaft cylinder when the writing material is gripped. However, when the user's fingers are positioned on the rib, which abuts against the surface of the shaft cylinder, the rib is pivoted along the circumference of the shaft cylinder depending on the magnitude of a force exerted by the user's fingers. Consequently, deformation of the grip is not uniform and it is possible that the user cannot reliably grip the writing material with the user fingers placed at desired positions.

Furthermore, the grip formed like cylinders having an inner peripheral surface fitted on an outer peripheral surface of a gripped area of the shaft cylinder, a plurality of a hollow portions formed in a peripheral wall of the cylinder so as to penetrate the cylinder in its axial direction and arranged along a circumference of the shaft cylinder and a ventilation passage formed at an end of the grip to allow the communication between the hollow portions and the exterior has been proposed. In this case, air moves freely to and from the exterior through the ventilation passage. Accordingly, even if the user exerts a force on the grip with his or her fingers during writing, the hollow portions can be readily deformed to absorb the pressure. However, the plurality of hollow portions, arranged in parallel along the circumference of the shaft cylinder, are separated from one another by a support portion. Thus, in the hollow portions, air can flow easily in the axial direction of the shaft cylinder but not along the circumference of the shaft cylinder. As a result, the support portion, which separates the hollow portions from one another, repels the pressure from the user's fingers. This makes deformation of the grip nonuniform as previously described. In particular, since the hollow portions are formed in the axial direction of the axial shaft, the positions of the user's fingers are likely to be shifted downward during use. Thus, when the user keeps on writing for a long hours, the user cannot reliably grip the writing material and thus exerts an unnecessary force. This results in excessive burdens on the user's fingers.

A problem with the prior art is that during writing, notably during long writing, the user cannot grip the writing material at the optimum positions. It is thus an object of the present invention to allow the grip of the writing material to be optimally deformed with respect to the positions of the user's fingers, at which the writing material is directly gripped, and in response to the pressure from the fingers or the like and remain in the deformed state.

SUMMARY OF THE INVENTION

To accomplish the above object, the present invention provides a writing material comprising a shaft cylinder having an opening at an end of the shaft cylinder in which a writing lead is accommodated, a plurality of flange-like projections provided on a surface by the side of the end of the shaft cylinder and projecting in a radial direction of a diameter of the shaft cylinder, the flange-like projections lying in parallel to an axis of the shaft cylinder, and a cover of an elastic material which closely covers the plurality of flange-like portions so that spaces are formed between the cover and the plurality of flange-like projections, which spaces extend along a circumference of the shaft cylinder.

The grip of the writing material in accordance with the present invention is readily deformed in response to pressure from a user's fingers to sufficiently absorb the pressure. This is because, inside the cover of the grip, air in the spaces defined by the cover and the flange-like or spiral projections flows through the spaces, is compressed and is thus readily deformed; the flange-like or spiral projections are formed on the surface of the shaft cylinder supporting the cover. If the cover is strong enough to avoid damage that may otherwise occur when the writing material is used for a long time, the cover becomes harder and more difficult to deform under the pressure from the user's fingers. However, the cover is internally supported by the flange-like or spiral projections so that, it is still readily deformed in spite of its hardness and strength. The cover thus absorbs the pressure from the fingers to reduce burdens on the user's fingers. Moreover, the cover is supported by the adjacent flange-like or spiral projections, formed on the surface of middle shaft portion of the axial shaft and constituting the spaces. This suppresses the deformation of the cover to maintain the fixed shape of the cover while bearing the pressure from the fingers. This allows the optimum positions of the user's fingers to be maintained and the fingers can hardly shift. Therefore, with the simple structure, a reduction in burdens on the user's fingers can be achieved allowing the user to reliably use the writing material for a long hours.

Furthermore, locking grooves are engraved in a surface of the cover in association with the flange-like projections or spiral projections formed on the surface of middle shaft portion of the shaft cylinder so that the fingers are naturally positioned on areas other than the locking grooves during gripping and that the fingers press areas of the cover which do not include the flange-like or spiral projections, which support the cover. This allows the pressure from the fingers to be reliably absorbed during gripping.

DETAILED DESCRIPTION OF THE INVENTION

Figure 1:
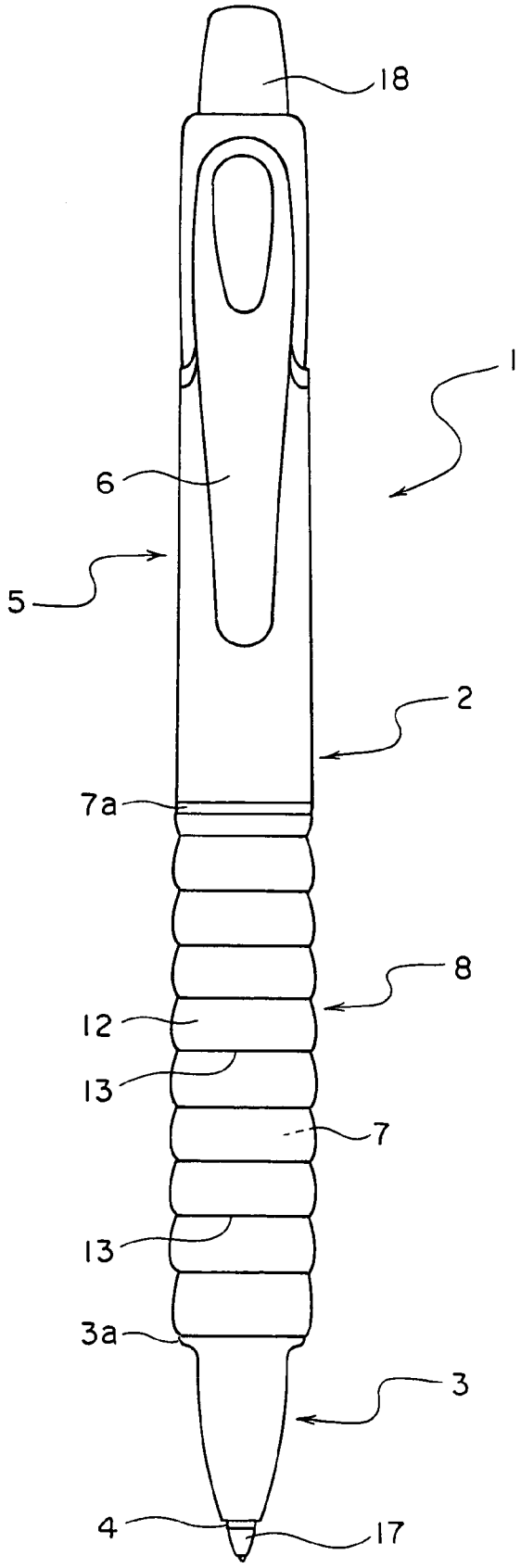
FIG. 1 is a front view of a writing material comprising a grip in accordance with an embodiment of the present invention.
Figure 2:
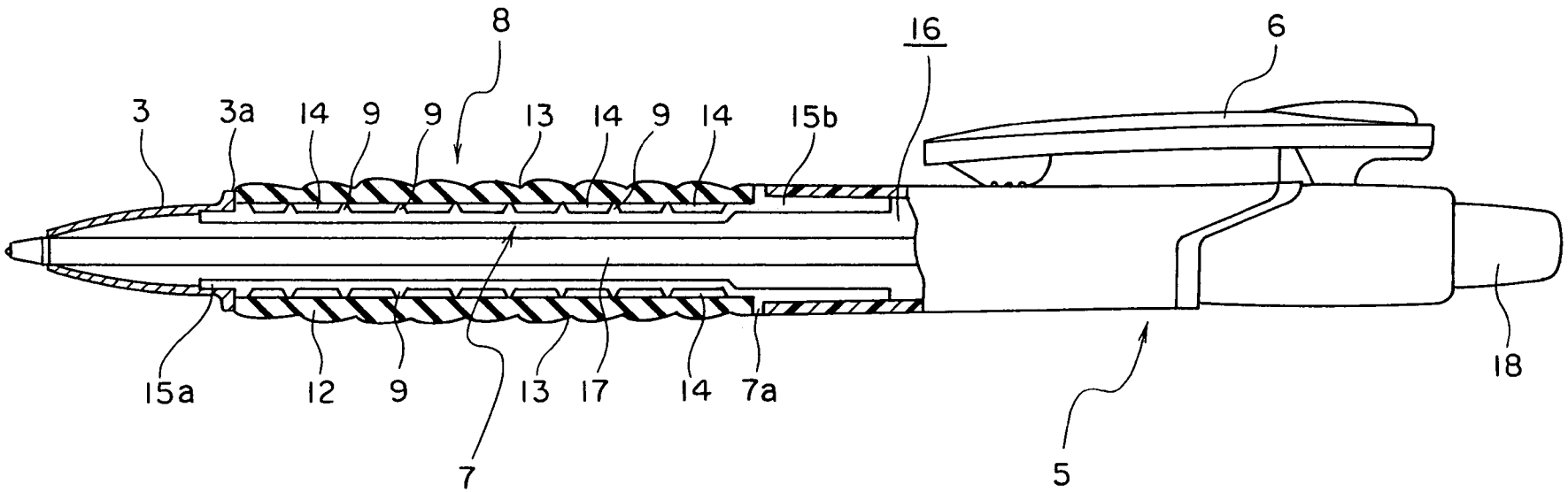
FIG. 2 is a sectional view of essential parts of the writing material comprising the grip in accordance with the embodiment of the present invention.
Figure 3:
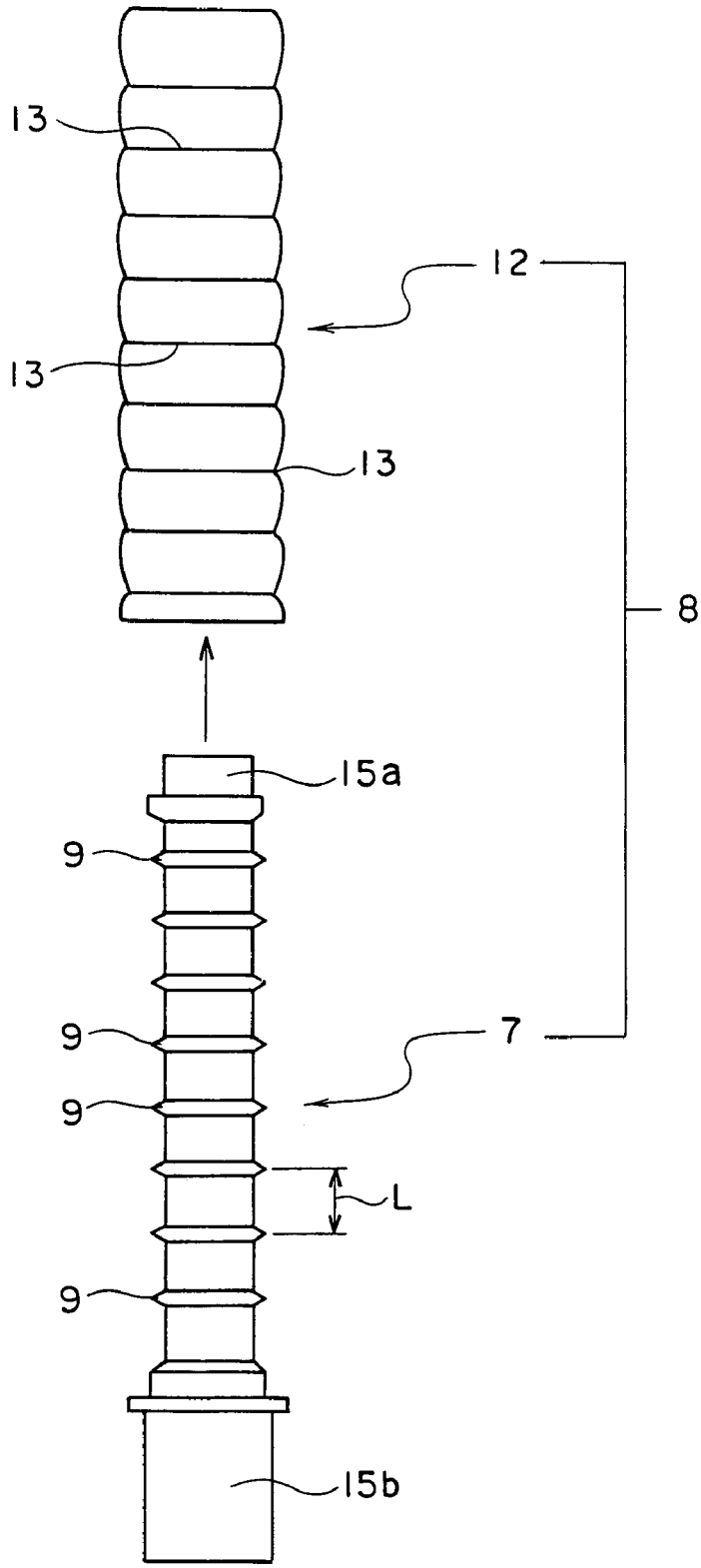
FIG. 3 is an exploded front view of a middle shaft portion constituting the grip in accordance with the embodiment of the present invention.

FIG. 1 shows a writing material (1) comprising a grip (8) in accordance with an embodiment of the present invention. The grip (8) comprises a shaft cylinder (2) and a lead advancing and withdrawing mechanism (16). The shaft cylinder (2) includes a leading shaft portion (3) having an opening (4) at a leading end of the leading shaft portion (3), a rear shaft portion (5) provided with a clip (6) near a rear end of the rear shaft portion (5), and a middle shaft portion (7) that integrally connects the leading shaft portion (3) and rear shaft portion (5) together via a front connection (15*a*) and a rear connection (15*b*). The lead advancing and withdrawing mechanism (16) is housed in the shaft cylinder (2) and which advances and withdraws the writing lead (17) of, for example, a ballpoint pen or a mechanical pencil, out of and into the opening (4) at the leading end of the shaft cylinder (2) when the user knocks a knock member (18) projecting from the rear end of the shaft cylinder (2). In the present embodiment, the shaft cylinder (2) includes the three members, the leading end portion (3), the middle shaft portion (7), and the rear shaft portion (5). However, the shaft cylinder (2) may be integrally formed as a unit.

The grip (8) in accordance with the embodiment of the present invention is integrally formed by closely covering a surface of the middle shaft portion (7) of the shaft cylinder (2) with a cover (12).

A plurality of rigid flange-like or annular projections (9) formed as a unit with the surface of the middle shaft portion (7) constituting the shaft cylinder (2) of the writing material (1). The flange-like projections (9) project in a radial direction of the shaft cylinder and in parallel to an axial direction of the shaft cylinder (2). On the other hand, the cover (12) consists of an elastic member and has a plurality of locking grooves (13) engraved in a surface of the cover (12) so that each groove corresponds to the position of one of the plurality of flange-like projections (9) provided on the surface of the middle shaft portion (7) of the shaft cylinder (2)

The grip (8) of the writing material is formed by following process. Firstly, the cover (12) is fittingly inserted around the shaft cylinder from a leading end of the middle shaft portion (7), constituting the shaft cylinder (2), to a flange portion (7*a*) of the middle shaft portion (7). Secondly, the front connection (15*a*) of the middle shaft portion (7) is fittingly inserted into the leading shaft portion (3) so that the cover (12) covers the plurality of flange-like projections (9) and that the opposite ends of the cover (12) are integrally sealed by a flange portion (3*a*) of the leading shaft portion (3) and the flange portion (7*a*) of the middle shaft portion (7).

Figure 4:
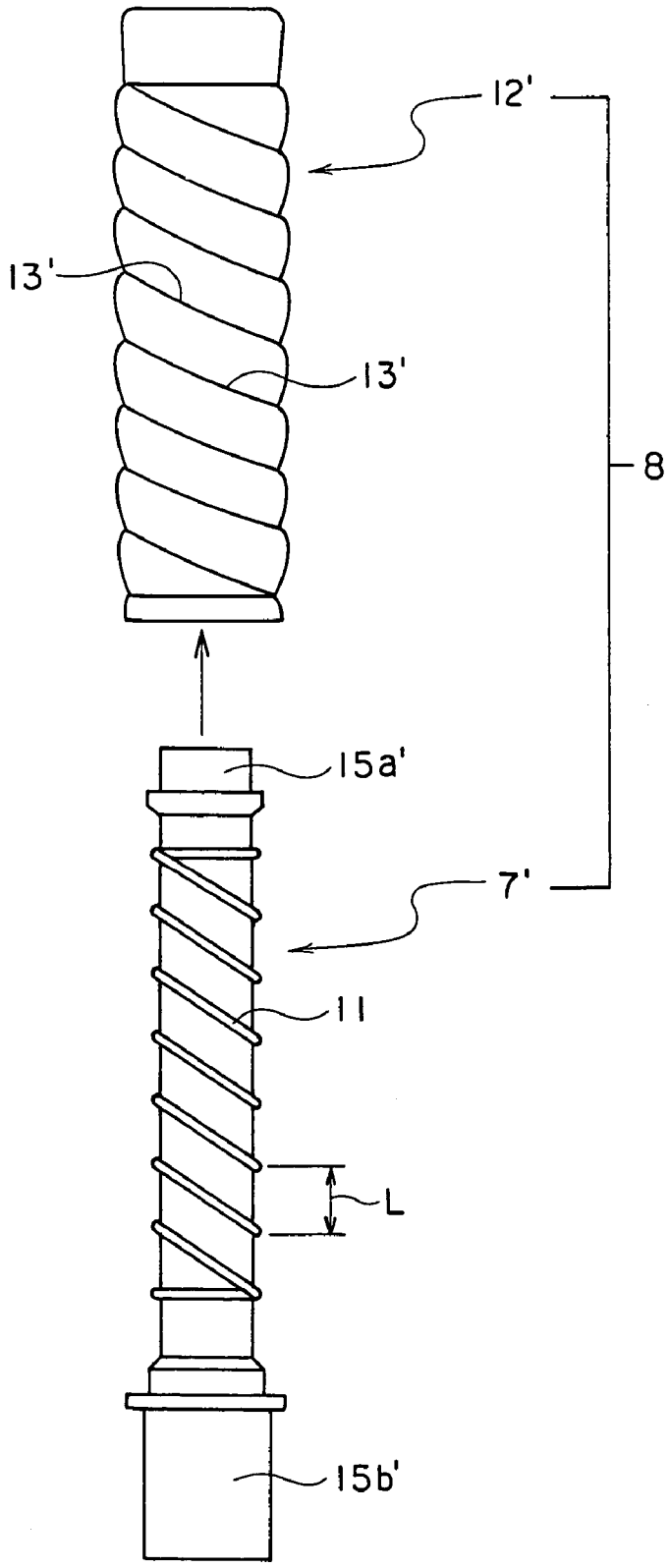
FIG. 4 is an exploded front view of a variation of the middle shaft portion constituting the grip in accordance with the embodiment of the present invention.

The plurality of flange-like projections (9), provided on the surface of the middle shaft portion (7) and in parallel across the axis of the shaft cylinder (2) of the writing material (1) can be altered into a plurality of spiral projections (11) similarly projecting from the surface of the middle shaft portion (7) in a radial direction of the shaft and integrally and consecutively disposed on the surface of the middle shaft portion (7) (see FIG. 4). This configuration facilitates a process of manufacturing a middle shaft portion (7') having the spiral projections (11) formed on its surface.

The appropriate interval L between the plurality of flange-like projections (9) or spiral projections (11) is 4 to 6 mm; the flange-like projections (9) are provided on the surface of the middle shaft portion (7) and in parallel to the axis of the shaft cylinder and the spiral projections (11) are integrally and consecutively disposed on the surface of the middle shaft portion (7). If the user grips the grip (8) with his or her fingers (f) and when the fingers (F) press areas other than the locking grooves (13), engraved in the surface of the cover (12), to deform the flange-like projections (9) or spiral projections (11), corresponding to the locking grooves (13)

and resisting the pressure from the fingers, the above interval prevents the projections from being markedly deformed to shift the user's fingers.

On the other hand, the cover (12), which closely covers the plurality of flange-like portions (9) or integrally consecutively disposed spiral projections (11), comprises most preferably elastomer rubber or silicone rubber consisting of ABS or polyester. This material has a certain hardness enough to prevent damage to the cover (12) which may otherwise occur when the writing material is used for a long time. Nevertheless, the material is readily deformed so as to sufficiently absorb the pressure from the user's fingers (F). The material can also maintain a sufficient durability in spite of the user's sweat or grease and repeated operations.

Figure 5:
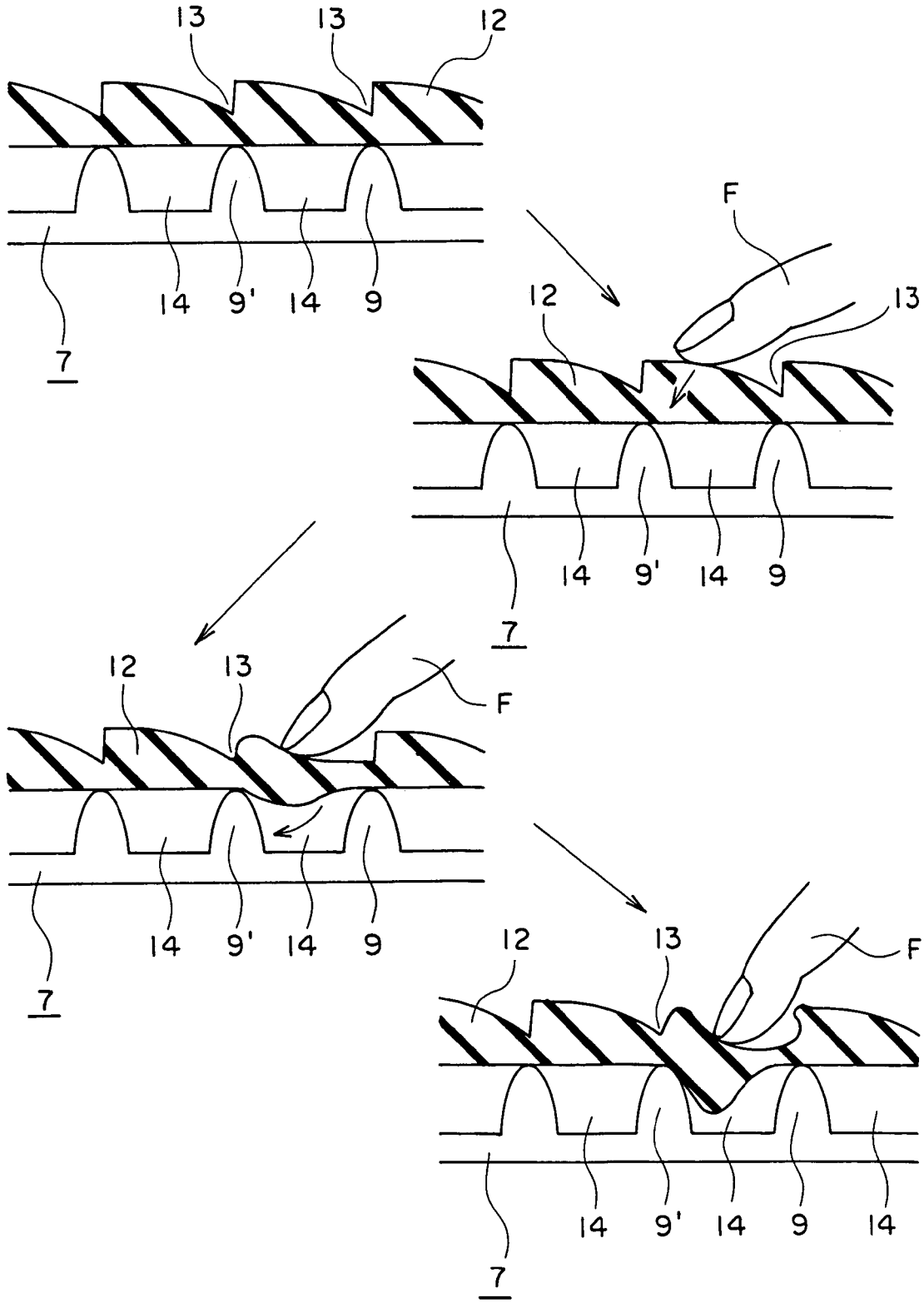
FIG. 5 is a schematic view showing how the grip in accordance with the embodiment of the present invention functions.

Thus, the grip (8) of the writing material according to the embodiment of the present invention forms spaces (14) extending along the circumference of the shaft cylinder, between the cover (12) and the adjacent flange-like projections (9) or spiral projections (11) by using the cover (12) to cover the plurality of flange-like projections (9), provided on the surface of the middle shaft portion (7) and in parallel to the axis of the shaft cylinder, or the plurality of spiral projections (11), integrally and consecutively disposed on the surface of the middle shaft portion (7). Accordingly, as shown in FIG. 5, when the user grips and presses the grip (8) with his or her fingers, the cover (12) is deformed over the projections (9) due to the resistance from the rigid flange-like or annular projections (9) or spiral projections (11). This causes air within the space (14) to flow and to be compressed. The cover (12) is thus deformed at each of the spaces (14), formed to extend along the circumference of the shaft cylinder, to absorb the pressure.

Figure 6:
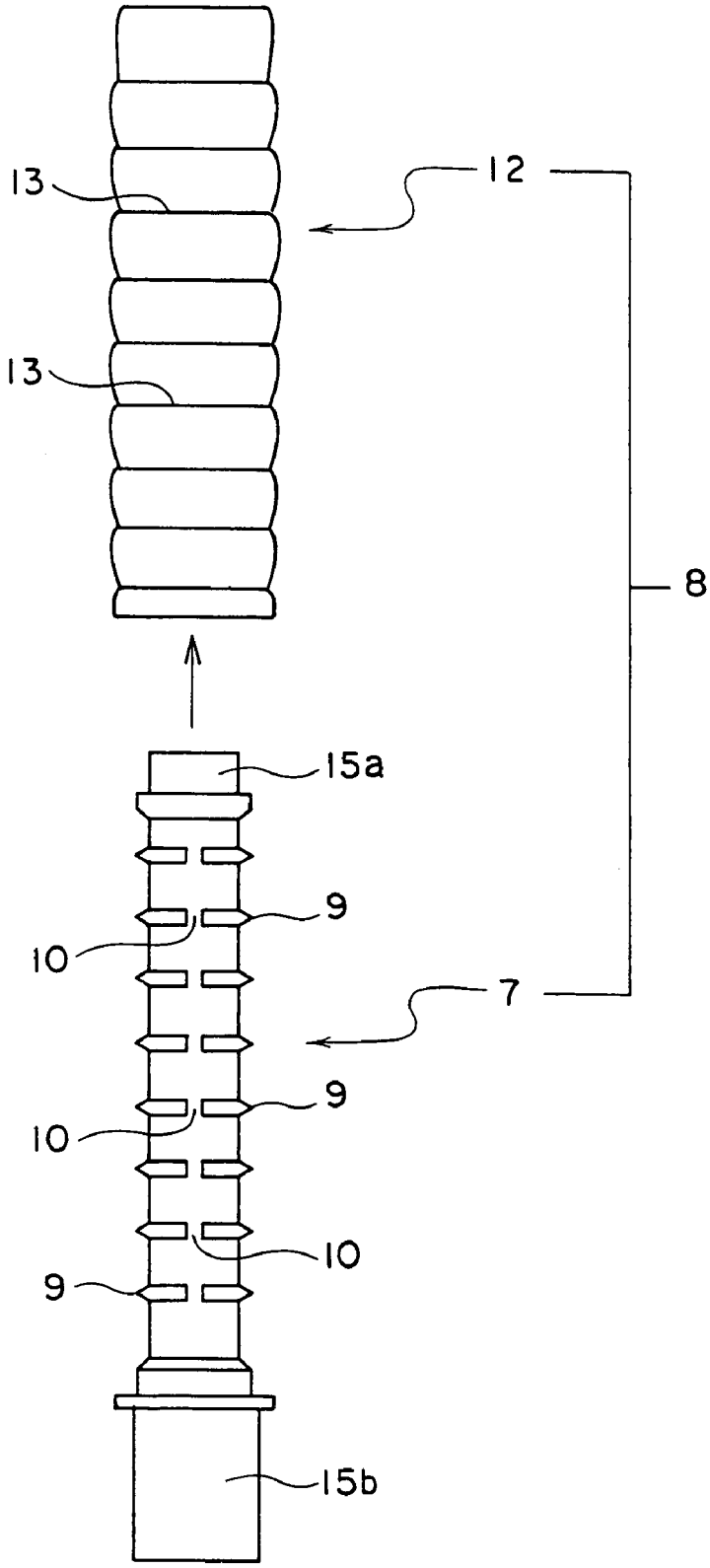
FIG. 6 is an exploded front view of another variation of the middle shaft portion constituting the grip in accordance with the embodiment of the present invention.

The spaces (14), formed by the cover (12) and the plurality of flange-like projections (9), extend along the circumference of the shaft cylinder. The spaces (14) are independent of one another. In this case, a slit (10) may be formed in a part of each of the flange-like projections (9) so as to allow air to flow smoothly through each spaces (14). This enables the grip (8) to be deformed more quickly and greatly when the user grips the grip (8) of the writing material (1) (see FIG. 6).

Since the grip (8) of the writing material in accordance with the embodiment of the present invention is configured as described above, it functions as shown in FIG. 5 when the writing material (1) is used.

First, when the user grips the grip (8) according to the embodiment of the present invention to use the writing material (1), the user's fingers (F) fit in the portion except for the locking grooves (13), engraved in the surface of the cover (12), constituting the grip (8) of the writing material.

Then, when the user exerts an additional force through his or her fingers (f) to grip the writing material (1), the cover (12) is deformed in the directions of the axis and circumference of the shaft cylinder.

Inside the cover (12), the plurality of flange-like projections (9), provided in parallel to the axis of the shaft cylinder, bears the cover (12) so that bearing power acts in the radial direction of the shaft cylinder. The spaces (14) spreading along the circumference of the cylinder shaft are each formed between the flange-like projections (9). Since each locking groove (13) in the cover (12) has a corresponding flange-like projection (9), provided in parallel to the axis of the shaft cylinder, when the cover (12) starts to deform in the axial direction of the shaft cylinder the corresponding flange-like projections (9) react to the cover (12). Thus, the air in the spaces (14) flows along the circumference of the shaft cylinder to be compressed so that the cover (12) borne by the adjacent flange-like projections (9) (9') is gradually deformed.

Thus, when the user grips the grip (8) of the writing material (1), the cover (12) is deformed. Between the adjacent flange-like projections (9) and (9'), however, the cover (12) is deformed slowly, therefore the user's fingers (F) remain shifted downward. Moreover, the pressure from the user's fingers (F) is absorbed by the elasticity of the cover (12) and the air in the spaces (14). This prevents excessive deformation that may otherwise occur in the prior art when the writing material is used for a long hours. The user's fatigue is also prevented.

The user can thus continuously use the writing material without suffering excessive burdens on the user's fingers (F).

On the other hand, after the use of the writing material (1), when the user releases the grip (8), the cover (12) recovers its original state owing to the restitution force inside and outside the cover (12) resulting from the deformation of the cover (12), which restitution force comprises the pressure of the compressed air in the spaces (14) and the elasticity of the cover (12) itself. Accordingly, regardless of the manners in which an unspecified number of users use the writing material, the cover (12) recovers its original shape after use. Every next user can grip and use the writing material (1) in its initial optimum state.

Since the grip in accordance with the present invention can absorb pressure while maintaining the desired positions of the user's fingers, the grip is applicable not only to mechanical pencils and ballpoint pens but also any other writing materials used for a long hours.

The invention claimed is:

1. A writing material comprising:

a shaft cylinder having an opening at an end thereof in which a writing lead is accommodated;

a plurality of rigid annular projections formed around an entire circumference of the shaft cylinder as a unit with an outer surface of the shaft cylinder and projecting in a radial direction of a diameter of said shaft cylinder, said annular projections lying in parallel to an axis of said shaft cylinder; and a cover of an elastic material in abutting engagement on free ends of the plurality of annular projections so that spaces extending along the circumference of said shaft cylinder are formed between said cover and said plurality of annular projections.

2. The grip of the writing material according to claim 1, wherein said plurality of annular projections are substituted by consecutively formed spiral projections formed around the entire circumference of the shaft cylinder as a unit with the outer surface of the shaft cylinder.

3. The grip of the writing material according to claim 2, wherein said cover has a plurality of locking grooves formed in a surface of said cover so that each said locking groove corresponds to one of said spiral projections.

4. The grip of the writing material according to claim 1, wherein said cover has a plurality of locking grooves formed in a surface of said cover so that each said locking groove corresponds to one of said annular projections.

5. A writing material comprising:

a shaft cylinder having a middle shaft portion;

a plurality of annular projections formed around an entire circumference of the shaft cylinder as a unit with an outer surface of the middle shaft portion and projecting in a radial direction of a diameter of said shaft cylinder, said annular projections lying in parallel to an axis of said shaft cylinder; and a cover of an elastic material engaged on the plurality of annular projections so that spaces extending along a circumference of said middle shaft portion are formed between said cover and said plurality of annular projections.

6. The grip of the writing material according to claim 5, wherein said plurality of annular projections are substituted by consecutively formed spiral projections formed around the entire circumference of the shaft cylinder as a unit with the surface of the shaft cylinder.

7. The grip of the writing material according to claim 6 wherein said cover has a plurality of locking grooves formed in a surface of said cover so that each said locking groove corresponds to one of said spiral projections.

8. The grip of the writing material according to claim 5 wherein said cover has a plurality of locking grooves formed in a surface of said cover so that each said locking groove corresponds to one of said annular projections.

* * * * *